US009243192B2

(12) United States Patent
Yanagawa et al.

(10) Patent No.: US 9,243,192 B2
(45) Date of Patent: Jan. 26, 2016

(54) METHOD FOR PRODUCING AROMATIC HYDROCARBONS

(75) Inventors: Shinichiro Yanagawa, Tokyo (JP); Yuko Aoki, Tokyo (JP); Kazuaki Hayasaka, Tokyo (JP)

(73) Assignee: JX NIPPON OIL & ENERGY CORPORATION, Tokyo (JP)

( * ) Notice: Subject to any disclaimer, the term of this patent is extended or adjusted under 35 U.S.C. 154(b) by 68 days.

(21) Appl. No.: 13/138,064

(22) PCT Filed: Mar. 26, 2010

(86) PCT No.: PCT/JP2010/002160

§ 371 (c)(1),
(2), (4) Date: Jun. 28, 2011

(87) PCT Pub. No.: WO2010/109897

PCT Pub. Date: Sep. 30, 2010

(65) Prior Publication Data

US 2011/0270005 A1 Nov. 3, 2011

(30) Foreign Application Priority Data

Mar. 27, 2009 (JP) ..... 2009-078596

(51) Int. Cl.

| | |
|---|---|
| ***C07C 5/367*** | (2006.01) |
| ***C10G 35/095*** | (2006.01) |
| ***C10G 45/68*** | (2006.01) |
| ***C10G 63/04*** | (2006.01) |

(Continued)

(52) U.S. Cl.

CPC ..... *C10G 35/095* (2013.01); *C10G 45/54* (2013.01); *C10G 45/68* (2013.01); *C10G 49/007* (2013.01); *C10G 63/04* (2013.01); *C10G 69/04* (2013.01); *C10G 2300/4012* (2013.01); *C10G 2400/30* (2013.01)

(58) Field of Classification Search

USPC ..... 585/430, 251, 256

See application file for complete search history.

(56) References Cited

U.S. PATENT DOCUMENTS 3,479,279 A 11/1969 Pohlenz
3,799,864 A * 3/1974 Bunn et al. ..... 208/80

(Continued)

FOREIGN PATENT DOCUMENTS

CA 2651741 11/2007
CN 85104308 12/1986

(Continued)

OTHER PUBLICATIONS

Barker et al., Kirk-Othmer Encyclopedia of Chemical Technology, 2005, John Wiley and Sons, Inc.*

(Continued)

*Primary Examiner* — In Suk Bullock
*Assistant Examiner* — Youngsul Jeong
(74) *Attorney, Agent, or Firm* — Kenyon & Kenyon LLP

(57) ABSTRACT

A method for producing aromatic hydrocarbons by bringing a feedstock derived from a fraction containing a light cycle oil produced in a fluid catalytic cracking into contact with a catalyst containing a crystalline aluminosilicate, wherein the proportion of the naphthene content within the feedstock is adjusted so as to be greater than the proportion of the naphthene content in the fraction containing the light cycle oil, and the contact between the feedstock and the catalyst is performed under a pressure within a range from 0.1 MPaG to 1.0 MPaG.

5 Claims, 3 Drawing Sheets

(51) Int. Cl.

| | |
|---|---|
| ***C10G 69/04*** | (2006.01) |
| ***C10G 45/54*** | (2006.01) |
| ***C10G 49/00*** | (2006.01) |

(56) References Cited

U.S. PATENT DOCUMENTS

| | | | | |
|---|---|---|---|---|
| 4,585,545 | A * | 4/1986 | Yancey et al. | 208/74 |
| 4,985,134 | A | 1/1991 | Derr, Jr. et al. | |
| 5,219,814 | A * | 6/1993 | Kirker et al. | 502/66 |
| 6,124,515 | A * | 9/2000 | Wu et al. | 585/418 |
| 2007/0062848 | A1 | 3/2007 | Oballa et al. | |

FOREIGN PATENT DOCUMENTS

| | | |
|---|---|---|
| CN | 85101896 | 1/1987 |
| CN | 1187840 | 7/1998 |
| CN | 1187843 | 7/1998 |
| EP | 0 038 140 | 10/1981 |
| EP | 0 184 669 | 6/1986 |
| EP | 0 212 788 | 3/1987 |
| EP | 2351820 | 8/2011 |
| GB | 1 287 722 | 1/1970 |
| JP | 56-157488 | 4/1981 |
| JP | 61-148295 | 7/1986 |
| JP | 61-283687 | 12/1986 |
| JP | 03-002128 | 1/1991 |
| JP | 03-026791 | 2/1991 |
| JP | 03-52993 | 3/1991 |
| JP | 2007-154151 | 6/2007 |
| JP | 2009-235247 | 10/2009 |
| JP | 2009-235248 | 10/2009 |
| WO | WO 90/15121 | 12/1990 |
| WO | WO 00/40677 | 7/2000 |
| WO | WO 01/79382 | 10/2001 |

OTHER PUBLICATIONS

International Search Report dated Apr. 20, 2010 issued in corresponding PCT Application No. PCT/JP2010/002160.

Chinese Search Report dated Jun. 20, 2013 issued in corresponding Chinese Application No. 201080013465.0 (with English Translation).

Search Report dated Dec. 22, 2014 issued in corresponding European Application No. 10755699.5.

* cited by examiner

METHOD FOR PRODUCING AROMATIC HYDROCARBONS

TECHNICAL FIELD

The present invention relates to a method for producing monocyclic aromatic hydrocarbons.

This application is a national stage application of International Application No. PCT/JP2010/002160, filed Mar. 26, 2010, which claims priority to Japanese Patent Application No. 2009-078596, filed Mar. 27, 2009, the content of which is incorporated herein by reference.

BACKGROUND ART

In recent years, techniques have been sought that enable the efficient production of monocyclic aromatic hydrocarbons of 6 to 8 carbon number (such as benzene, toluene, ethylbenzene and xylene, which are hereinafter jointly referred to as the "BTX fraction"), which can be used as high-octane gasoline base stocks or petrochemical feedstocks and offer significant added value, from feedstocks containing polycyclic aromatic hydrocarbons such as light cycle oil (hereinafter also referred to as LCO), which is a cracked light oil produced in a fluid catalytic cracking (hereinafter also referred to as FCC) that has conventionally been used as a diesel oil or heating oil fraction.

Examples of known methods for producing a BTX fraction from polycyclic aromatic hydrocarbons include the methods listed below.

(1) Methods of hydrocracking hydrocarbons containing polycyclic aromatic hydrocarbons in a single stage (see Patent Documents 1 and 2).

(2) Methods of subjecting hydrocarbons containing polycyclic aromatic hydrocarbons to a hydrotreatment in a preliminary stage and then hydrocracking in a subsequent stage (see Patent Documents 3 to 5).

(3) A method of converting hydrocarbons containing polycyclic aromatic hydrocarbons directly into a BTX fraction using a zeolite catalyst (see Patent Document 6).

(4) Methods of converting a mixture of hydrocarbons containing polycyclic aromatic hydrocarbons and light hydrocarbons of 2 to 8 carbon number into a BTX fraction using a zeolite catalyst (see Patent Documents 7 and 8).

However, the methods of (1) and (2) require the addition of high-pressure molecular hydrogen, and the high level of hydrogen consumption is also a problem. Further, under the hydrogenation conditions employed, an unnecessary LPG fraction tends to also be produced in a large amount during production of the target BTX fraction, and not only is energy required to separate this LPG fraction, but the feedstock efficiency also deteriorates.

The method of (3) was not entirely satisfactory in terms of conversion of the polycyclic aromatic hydrocarbons.

The methods of (4) have been designed to improve the thermal balance by combining a production technique for BTX that employs light hydrocarbons as a feedstock and a production technique for BTX that employs hydrocarbons containing polycyclic aromatic hydrocarbons as a feedstock, but have not been designed to improve the yield of BTX from the polycyclic aromatic fraction.

DOCUMENTS OF RELATED ART

Patent Documents

[Patent Document 1]
Japanese Unexamined Patent Application, First Publication No. Sho 61-283687

[Patent Document 2]
Japanese Unexamined Patent Application, First Publication No. Sho 56-157488
[Patent Document 3]
Japanese Unexamined Patent Application, First Publication No. Sho 61-148295
[Patent Document 4]
UK Patent No. 1,287,722
[Patent Document 5]
Japanese Unexamined Patent Application, First Publication No. 2007-154151
[Patent Document 6]
Japanese Unexamined Patent Application, First Publication No. Hei 3-2128
[Patent Document 7]
Japanese Unexamined Patent Application, First Publication No. Hei 3-52993
[Patent Document 8]
Japanese Unexamined Patent Application, First Publication No. Hei 3-26791

SUMMARY OF INVENTION

Problems to be Solved by the Invention

An object of the present invention is to provide a method for producing a BTX fraction from a fraction containing a light cycle oil (LCO) produced in an FCC unit, which does not require the coexistence of molecular hydrogen and enables a more efficient production of the BTX fraction than conventional methods.

Means to Solve the Problems

As a result of intensive research aimed at achieving the above object, the present inventors discovered that by using a feedstock having an adjusted proportion for the naphthene content within a fraction containing a light cycle oil (LCO) produced in an FCC unit, and reacting the feedstock by bringing it into contact with a catalyst containing a crystalline aluminosilicate under low pressure and in the absence of molecular hydrogen, a BTX fraction could be produced with good efficiency, and they were therefore able to complete the present invention.

In other words, a method for producing aromatic hydrocarbons according to the present invention involves bringing a feedstock derived from a fraction containing a light cycle oil (LCO) produced in an FCC unit into contact with a catalyst containing a crystalline aluminosilicate, wherein the proportion of the naphthene content within the feedstock is adjusted so as to be greater than the proportion of the naphthene content in the fraction containing the LCO, and the contact between the feedstock and the catalyst is performed under a pressure within a range from 0.1 MPaG to 1.0 MPaG.

The proportion of the naphthene content within the feedstock is preferably adjusted by (i) mixing the fraction containing the LCO with a hydrotreated oil (and preferably an oil obtained by partially hydrogenating the LCO), or (ii) partially hydrogenating the fraction containing the LCO.

The proportion of the naphthene content within the feedstock is preferably at least 10% by mass, and is more preferably 15% by mass or higher.

The naphthene preferably contains mainly naphthene components of 8 or more carbon number.

The mass ratio between the naphthene content and the polycyclic aromatic content within the feedstock (naphthene content/polycyclic aromatic content) is preferably within a range from 0.3 to 3.

The catalyst preferably further includes gallium and/or zinc.

Effect of the Invention

The method for producing aromatic hydrocarbons according to the present invention produces a BTX fraction from a fraction containing an LCO produced in an FCC unit without requiring the coexistence of molecular hydrogen and with superior efficiency compared to conventional methods.

DESCRIPTION OF EMBODIMENTS

Figure 1:
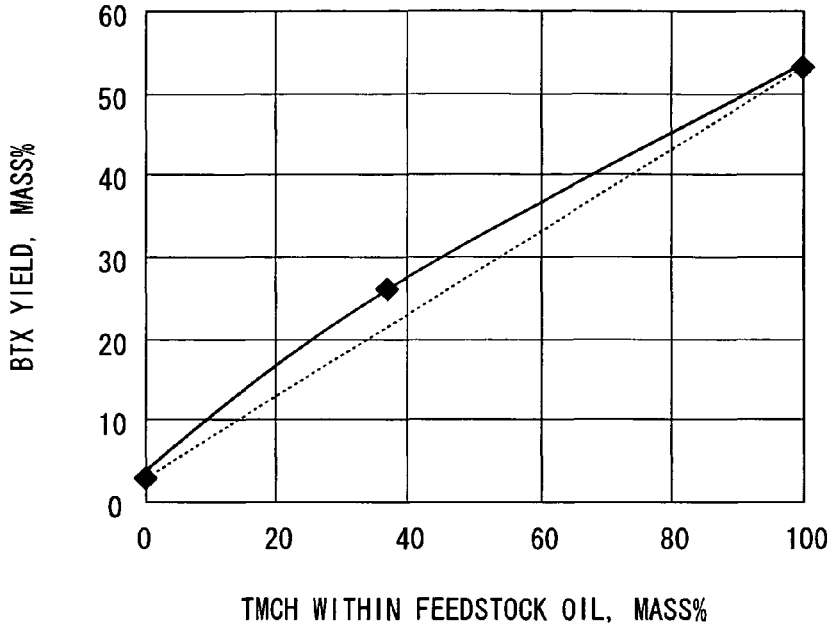
FIG. 1 is a graph illustrating the relationship between the proportion of 1,2,4-trimethylcyclohexane within a feedstock oil of a reference example 1, and the BTX yield.

The method for producing aromatic hydrocarbons according to the present invention involves bringing a feedstock derived from a fraction containing an LCO produced in an FCC unit into contact with a catalyst containing a crystalline aluminosilicate, thereby reacting the feedstock and producing aromatic hydrocarbons, wherein the proportion of the naphthene content within the feedstock is adjusted so as to be greater than the proportion of the naphthene content in the fraction containing the LCO that functions as the base for the feedstock, and the contact between the feedstock and the catalyst is performed under a pressure within a range from 0.1 MPaG to 1.0 MPaG.

(Feedstock)

The feedstock is derived from a fraction containing an LCO produced in an FCC unit, wherein the proportion of the naphthene content within the feedstock has been adjusted so as to be greater than the proportion of the naphthene content in the fraction containing the LCO.

In the present invention, the reason for adjusting the proportion of the naphthene content within the feedstock to a value greater than the proportion of the naphthene content in the fraction containing the LCO that functions as the base for the feedstock is because the present inventors discovered that by achieving an efficient contact between the naphthenic hydrocarbons and the polycyclic aromatic hydrocarbons, the polycyclic aromatic hydrocarbons could be converted more efficiently into a BTX fraction.

In order to obtain a BTX fraction from the polycyclic aromatic hydrocarbons that is contained in a large amount within the LCO, at least one aromatic ring of the polycyclic aromatic hydrocarbons must be cracked open, and therefore a hydrogen donor source preferably coexists within the reaction system. Accordingly, in conventional methods for producing a BTX fraction from polycyclic aromatic hydrocarbons, molecular hydrogen is introduced into the system, and the polycyclic aromatic hydrocarbons are hydrocracked under high pressure to produce a BTX fraction. However, these methods are not always ideal for a number of reasons, including the need to introduce molecular hydrogen, the fact that the reaction occurs under high pressure meaning there are restrictions on the production apparatus, and the fact that the amount of non-targeted by-products such as an LPG fraction of lower paraffins tends to increase.

On the other hand, another known method involves using saturated hydrocarbon as the hydrogen donor source, and converting the polycyclic aromatic hydrocarbons to a BTX fraction via a hydrogen transfer reaction from the saturated hydrocarbon. Although this method offers the advantage of not requiring the use of molecular hydrogen, a hydrogen transfer agent and hydrogen transfer conditions that enable satisfactory conversion of the polycyclic aromatic hydrocarbons to a BTX fraction are not currently known.

As a result of intensive investigation, the present inventors discovered that by incorporating a large amount of a naphthene content (and particularly a multi-branched naphthene content) as a saturated hydrocarbon capable of producing an efficient hydrogen transfer reaction, and then performing the reaction under low pressure, a BTX fraction could be produced with good efficiency from the polycyclic aromatic hydrocarbons without requiring the presence of molecular hydrogen, and they were therefore able to complete the present invention. Although there are no particular limitations on the amount of paraffins mixed with the feedstock as a hydrogen transfer agent, efficient production of the BTX fraction using only paraffins is impossible, and the inclusion of a naphthene is essential.

Examples of the method used for adjusting the proportion of the naphthene content within the feedstock to a value greater than the proportion of the naphthene content in the fraction containing the LCO that functions as the base for the feedstock include the methods listed below.

(i) A method that involves mixing the fraction containing the LCO with a hydrotreated oil.

(ii) A method that involves partially hydrogenating the fraction containing the LCO.

The above-mentioned hydrotreated oil may be any oil fraction in which the proportion of the naphthene content is greater than the proportion of the naphthene content within the fraction containing the LCO that functions as the base for the feedstock, and examples of preferred hydrotreated oils include a distillate oil produced in an FCC unit (such as an LCO, heavy cycle oil (HCO) or clarified oil (CLO)), a fraction produced by partially hydrogenating a distillate oil produced in an FCC unit (such as a partially hydrogenated LCO, partially hydrogenated HCO or partially hydrogenated CLO), a distillate oil produced in a coker, a fraction produced by partially hydrogenating a distillate oil produced in a coker, a hydrocracked fraction having a large naphthene content, a cracked oil fraction produced in a heavy oil hydrocracking unit or a heavy oil hydrodesulfurizer, and a fraction produced by hydrotreating a fraction obtained from oil sands. Of these, a fraction produced by partially hydrogenating a distillate oil produced in an FCC unit (such as a partially hydrogenated LCO, partially hydrogenated HCO or partially hydrogenated CLO), a fraction produced by partially hydrogenating a distillate oil produced in a coker, a hydrocracked fraction having a large naphthene content, a cracked oil fraction produced in a heavy oil hydrocracking unit or a heavy oil hydrodesulfurizer, and a fraction produced by hydrotreating a fraction obtained from oil sands are particularly preferred as the proportion of the naphthene content within these oils is particularly high. The hydrotreated oil may also be composed of a combination of two or more of the above fractions.

In the method (i), the hydrotreated oil and the fraction containing the LCO may be mixed in advance, prior to introduction into the reactor, or the hydrotreated oil and the fraction containing the LCO may be mixed directly inside the reactor. In those cases where direct mixing is performed inside the reactor, the combined total of the naphthene content within the fraction containing the LCO and the naphthene content of the hydrotreated oil immediately prior to introduction into the reactor preferably satisfies the range described below.

The fraction containing the LCO prior to adjustment of the naphthene content may be either a fraction containing an LCO produced by an FCC unit, or a mixture of such a fraction with another distillate oil.

In order to actively utilize the hydrogen transfer reaction, the proportion of the naphthene content within the feedstock is preferably at least 10% by mass, and is more preferably 15% by mass or higher. Although there are no particular limitations on the upper limit for the naphthene content, adjusting the proportion of the naphthene content within the feedstock to a value exceeding 70% by mass is difficult using the above methods (i) and (ii).

In order to more efficiently utilize the hydrogen transfer reaction, the naphthene is preferably a multi-branched naphthene, and a naphthene having 8 or more carbon number, which is the number of carbon number required for a dialkylnaphthene, is preferable, and a naphthene having 9 or more carbon number is even more desirable. Accordingly, the proportion of the naphthene content having 8 or more carbon number within the entire naphthene content is preferably at least 50% by mass, and more preferably 80% by mass or greater. Further, a naphthene content in which the proportion of the fraction having 9 or more carbon number within the entire naphthene content is 80% by mass or greater is particularly desirable. As the multi-branched naphthene, preferred monocyclic naphthenes include dialkylcyclohexanes, trialkylcyclohexanes and tetraalkylcyclohexanes, whereas preferred polycyclic naphthenes include alkylated decalins, alkylated hydrindans, alkylated decahydroanthracenes and alkylated decahydrophenanthrenes. In the case of bicyclic or higher naphthenes such as decalin, from the perspective of a single ring, these structures can be considered equivalent to compounds having two alkyl chains, meaning they need not necessarily be alkylated.

These components are mixed together within the actual fraction, and separating individual components prior to use is impractical. Further, even in those cases where the composition of the naphthene is not entirely clear, provided the boiling point exceeds 120° C. (namely, the boiling point of dimethylcyclohexane, which represents the lowest boiling point among multi-branched naphthenes having 8 or more carbon number), the naphthene will have sufficient branching to produce an efficient hydrogen transfer reaction, and can therefore be used favorably.

The proportion of the polycyclic aromatic hydrocarbons within the feedstock is preferably within a range from 5 to 90% by mass, and more preferably from 10 to 60% by mass. If the proportion of the polycyclic aromatic hydrocarbons is less than 5% by mass, then the effect of the hydrogen transfer reaction is minimal, whereas if the proportion exceeds 90% by mass, then a satisfactory BTX yield is unobtainable, making the process inefficient.

Examples of the polycyclic aromatic hydrocarbons include typical polycyclic aromatic hydrocarbons such as alkylated naphthalenes, phenanthrenes and anthracenes. However, the tricyclic or higher aromatic content within the polycyclic aromatic hydrocarbons tends to cause a deterioration in the catalytic activity, and therefore the proportion of this tricyclic or higher aromatic hydrocarbons within the total polycyclic aromatic hydrocarbons is preferably not more than 30% by mass.

The mass ratio between the naphthene content and the polycyclic aromatic content (naphthene content/polycyclic aromatic content) within the feedstock is preferably within a range from 0.1 to 5.0, and more preferably from 0.3 to 3.0. Provided the naphthene content/polycyclic aromatic content ratio satisfies this range, the naphthene and the polycyclic aromatic hydrocarbons make efficient contact, enabling an efficient production of BTX from the polycyclic aromatic hydrocarbons via the hydrogen transfer reaction.

There are no particular limitations on the amounts of other components (such as the monocyclic aromatic hydrocarbon, paraffin (excluding the naphthene), and olefin) within the feedstock. Further, the feedstock may also include hetero atoms such as sulfur, oxygen and nitrogen, provided the targeted reaction is not markedly affected.

Although there are no particular limitations on the distillation characteristics of the feedstock, the 10 volume % distillation temperature of the feedstock is preferably at least 140° C., and more preferably 150° C. or higher. The 90 volume % distillation temperature of the feedstock is preferably not more than 360° C., and more preferably 350° C. or lower. With an oil having a 10 volume % distillation temperature of less than 140° C., the reaction involves production of a BTX fraction from a light feedstock, which is unsuitable for the present embodiment. Further, if a feedstock having a 90 volume % distillation temperature that exceeds 360° C. is used, then the amount of coke deposition on the catalyst tends to increase, causing a rapid deterioration in the catalytic activity.

The 10 volume % distillation temperature and the 90 volume % distillation temperature refer to values measured in accordance with the methods prescribed in JIS K 2254 "Petroleum products—determination of distillation characteristics".

(Catalyst)

The catalyst contains a crystalline aluminosilicate.

Although there are no particular limitations on the amount of the crystalline aluminosilicate within the catalyst, the amount is preferably within a range from 10 to 95% by mass, more preferably from 20 to 80% by mass, and still more preferably from 25 to 70% by mass.

Although there are no particular limitations on the crystalline aluminosilicate, medium pore size zeolites such as zeolites with MFI, MEL, TON, MTT, MRE, FER, AEL and EUO type crystal structures are preferred, and crystalline structures with MFI-type and/or MEL-type crystal structures are particularly desirable. MFI-type and MEL-type crystalline aluminosilicate are included within the conventional zeolite structures published by The Structure Commission of the International Zeolite Association (Atlas of Zeolite Structure Types, W. M. Meiyer and D. H. Olson (1978), distributed by Polycrystal Book Service, Pittsburgh, Pa. (USA).

In the crystalline aluminosilicate according to the present invention, the molar ratio between silicon and aluminum (Si/Al ratio) is not more than 100, and is preferably not more than 50. If the Si/Al ratio of the crystalline aluminosilicate exceeds 100, then the yield of monocyclic aromatic hydrocarbons tends to decrease.

Further, in terms of maximizing the yield of monocyclic aromatic hydrocarbons, the Si/Al ratio of the crystalline aluminosilicate is preferably at least 10.

The catalyst according to the present invention preferably also contains gallium and/or zinc. Including gallium and/or zinc enables a more efficient production of the BTX fraction, and also enables the production of by-products such as non-aromatic hydrocarbons of 3 to 6 carbon number to be largely suppressed.

Examples of crystalline aluminosilicates containing gallium and/or zinc include catalysts in which gallium is incorporated within the lattice framework of the crystalline aluminosilicate (crystalline aluminogallosilicates), catalysts in which zinc is incorporated within the lattice framework of the crystalline aluminosilicate (crystalline aluminozincosilicates), catalysts in which gallium is supported on the crystalline aluminosilicate (Ga-supporting crystalline aluminosilicates), catalysts in which zinc is supported on the crystalline aluminosilicate (Zn-supporting crystalline aluminosilicates), and catalysts including one or more of these forms.

A Ga-supporting crystalline aluminosilicate and/or Zn-supporting crystalline aluminosilicate can obtained by supporting gallium and/or zinc on a crystalline aluminosilicate using a conventional method such as an ion-exchange method or impregnation method. There are no particular limitations on the gallium source and zinc source used in these methods, and examples include gallium salts such as gallium nitrate and gallium chloride, gallium oxide, zinc salts such as zinc nitrate and zinc chloride, and zinc oxide.

The upper limit for the amount of gallium and/or zinc within the catalyst, based on an a value of 100% for the total mass of the catalyst, is preferably not more than 5% by mass, more preferably not more than 3% by mass, still more preferably not more than 2% by mass, and most preferably not more than 1% by mass. If the amount of gallium and/or zinc exceeds 5% by mass, then the yield of monocyclic aromatic hydrocarbons tends to decrease.

Further, the lower limit for the amount of gallium and/or zinc, based on a value of 100% for the total mass of the catalyst, is preferably at least 0.01% by mass, and more preferably 0.1% by mass or greater. If the amount of gallium and/or zinc is less than 0.01% by mass, then the yield of monocyclic aromatic hydrocarbons may decrease.

A crystalline aluminogallosilicate and/or crystalline aluminozincosilicate has a structure in which $SiO_4$, $AlO_4$ and $GaO_4/ZnO_4$ structures adopt tetrahedral coordination within the framework, and can be obtained by gel crystallization via hydrothermal synthesis, by a method in which gallium and/or zinc is inserted into the lattice framework of a crystalline aluminosilicate, or by a method in which aluminum is inserted into the lattice framework of a crystalline gallosilicate and/or crystalline zincosilicate.

The catalyst of the present invention preferably includes phosphorus. The amount of phosphorus within the catalyst, based on a value of 100% for the total mass of the catalyst, is preferably within a range from 0.1 to 10.0% by mass. In order to enable prevention of any deterioration over time in the yield of monocyclic aromatic hydrocarbons, the lower limit for the amount of phosphorus is preferably at least 0.1% by mass, and more preferably 0.2% by mass or greater. On the other hand, in order to maximize the yield of monocyclic aromatic hydrocarbons, the upper limit for the amount of phosphorus is preferably not more than 10.0% by mass, more preferably not more than 5.0% by mass, and still more preferably 2.0% by mass or lower.

There are no particular limitations on the method used for incorporating the phosphorus within the catalyst, and examples include methods in which an ion-exchange method or impregnation method or the like is used to support phosphorus on a crystalline aluminosilicate, crystalline aluminogallosilicate or crystalline aluminozincosilicate, methods in which a phosphorus compound is added during synthesis of the zeolite, thereby substituting a portion of the internal framework of the crystalline aluminosilicate with phosphorus, and methods in which a crystallization promoter containing phosphorus is used during synthesis of the zeolite. Although there are no particular limitations on the phosphate ion-containing aqueous solution used during the above methods, a solution prepared by dissolving phosphoric acid, diammonium hydrogen phosphate, ammonium dihydrogen phosphate or another water-soluble phosphate salt in water at an arbitrary concentration can be used particularly favorably.

The catalyst of the present invention can be obtained by calcining (at a calcination temperature of 300 to 900° C.) an above-mentioned phosphorus-supporting crystalline aluminogallosilicate or crystalline aluminozincosilicate, or a crystalline aluminosilicate having gallium/zinc and phosphorus supported thereon.

The catalyst of the present invention is used in the form of a powder, granules or pellets or the like, depending on the reaction format. For example, a powder is used in the case of a fluidized bed, whereas granules or pellets are used in the case of a fixed bed. The average particle size of the catalyst used in a fluidized bed is preferably within a range from 30 to 180 μm, and more preferably from 50 to 100 μm. Further, the bulk density of the catalyst used in a fluidized bed is preferably within a range from 0.4 to 1.8 g/cc, and more preferably from 0.5 to 1.0 g/cc.

The average particle size describes the particle size at which the particle size distribution obtained by classification using sieves reaches 50% by mass, whereas the bulk density refers to the value measured using the method prescribed in JIS R 9301-2-3.

In order to obtain a catalyst in granular or pellet form, if necessary, an inert oxide may be added to the catalyst as a binder, with the resulting mixture then molded using any of various molding apparatus.

In those cases where the catalyst according to the present invention contains a binder or the like, a compound that contains phosphorus may also be used as the binder, provided that the amount of phosphorus satisfies the preferred range described above.

Further, in those cases where the catalyst contains a binder, the catalyst may be produced by mixing the binder and the gallium- and/or zinc-supporting crystalline aluminosilicate, or mixing the binder and the crystalline aluminogallosilicate and/or crystalline aluminozincosilicate, and subsequently adding the phosphorus.

(Reaction Format)

Examples of the reaction format used for bringing the feedstock into contact with the catalyst for reaction include fixed beds, moving beds and fluidized beds. In the present invention, because a heavy oil fraction is used as the feedstock, a fluidized bed is preferred as it enables the coke fraction adhered to the catalyst to be removed in a continuous manner and enables the reaction to proceed in a stable manner. A continuous regeneration-type fluidized bed, in which the catalyst is circulated between the reactor and a regenerator, thereby continuously repeating a reaction-regeneration cycle, is particularly desirable. The feedstock that makes contact with the catalyst is preferably in a gaseous state. Further, the feedstock may be diluted with a gas if required. Furthermore, in those cases where unreacted feedstock occurs, this may be recycled as required.

(Reaction Temperature)

Although there are no particular limitations on the reaction temperature during contact of the feedstock with the catalyst for reaction, the reaction temperature is preferably within a range from 350 to 700° C., and more preferably from 450 to 650° C. If the reaction temperature is less than 350° C., then the reaction activity tends to be inadequate. If the reaction temperature exceeds 700° C., then not only is the reaction disadvantageous from an energy perspective, but regeneration of the catalyst also becomes difficult.

(Reaction Pressure)

The reaction pressure during contact of the feedstock with the catalyst for reaction is within a range from 0.1 MPaG to 1.0 MPaG. Because the present invention represents a completely different reaction concept to conventional methods based on hydrocracking, the high pressure conditions required for hydrocracking are completely unnecessary in the present invention. Rather, a higher pressure than is necessary actually promotes cracking, increasing the production of untargeted by-product light gases, and is consequently undesirable. Further, the fact that high pressure conditions are not required is also advantageous from the perspective of design of the reaction apparatus. On the other hand, the present invention focuses on actively utilizing the hydrogen transfer reaction, and in this regard, it has been found that pressurized conditions are more advantageous than normal pressure or reduced pressure conditions. In other words, provided the reaction pressure is within a range from 0.1 MPaG to 1.0 MPaG, the hydrogen transfer reaction can proceed in an efficient manner.

(Contact Time)

There are no particular limitations on the contact time between the feedstock and the catalyst, provided the desired reaction proceeds satisfactorily, but in terms of the gas transit time across the catalyst, the time is preferably within a range from 5 to 300 seconds, more preferably from 10 to 150 seconds, and still more preferably from 15 to 100 seconds. If the contact time is less than 1 second, then achieving substantial reaction is difficult. In contrast, if the contact time exceeds 300 seconds, then deposition of carbon matter on the catalyst due to coking or the like increases, the amount of light gas generated by cracking tends to increase, and the apparatus also tends to increase in size.

EXAMPLES

The present invention is described in more detail below based on a series of examples and comparative examples, but the present invention is in no way limited by these examples.

(Composition of Feedstock)

The respective compositions of the feedstock oils used in the examples and comparative examples were determined by performing a mass analysis by an EI ionization method (apparatus: JMS-700, manufactured by JEOL Ltd.) of the saturated hydrocarbons and the aromatic hydrocarbons obtained by separation by silica gel chromatography, and then analyzing the types of hydrocarbons in accordance with ASTM D 2425.

Catalyst Preparation Example 1

Preparation of a Catalyst Containing a Crystalline Aluminogallosilicate

A solution (A) composed of 1706.1 g of sodium silicate (J Sodium Silicate No. 3, $SiO_2$: 28 to 30% by mass, Na: 9 to 10% by mass, remainder: water, manufactured by Nippon Chemical Industrial Co., Ltd.) and 2227.5 g of water, and a solution (B-1) composed of 64.2 g of $Al_2(SO_4)_3.14\sim18H_2O$ (special reagent grade, manufactured by Wako Pure Chemical Industries, Ltd.), 32.8 g of $Ga(NO_3)_3.nH_2O$ (Ga: 18.51%, manufactured by Soekawa Chemical Co., Ltd.), 369.2 g of tetrapropylammonium bromide, 152.1 g of $H_2SO_4$ (97% by mass), 326.6 g of NaCl and 2975.7 g of water were prepared independently.

Subsequently, with the solution (A) undergoing continuous stirring at room temperature, the solution (B-1) was added gradually to the solution (A). The resulting mixture was stirred vigorously for 15 minutes using a mixer, thereby breaking up the gel and forming a uniform fine milky mixture.

This mixture was placed in a stainless steel autoclave, and a crystallization operation was performed under conditions including a temperature of 165° C., a reaction time of 72 hours, a stirring rate of 100 rpm, and under self-generated pressure. Following completion of the crystallization operation, the product was filtered, the solid product was recovered, and an operation of washing the solid product and then performing filtration was preformed 5 times, using a total of approximately 5 liters of deionized water in the 5 times of operations. The solid material obtained upon the final filtration was dried at 120° C., and was then calcined under a stream of air at 550° C. for 3 hours.

Analysis of the resulting calcined product by X-ray diffraction confirmed that the product had an MFI structure. Further, MASNMR analysis revealed a $SiO_2/Al_2O_3$ ratio (molar ratio), a $Si_2/Ga_2O_3$ ratio (molar ratio) and a $SiO_2/(Al_2O_3+Ga_2O_3)$ ratio (molar ratio) of 64.8, 193.2 and 48.6 respectively. Based on these results, the amount of aluminum element incorporated within the lattice framework was calculated as 1.32% by mass, and the amount of gallium incorporated within the lattice framework was calculated as 1.16% by mass.

A 30% by mass aqueous solution of ammonium nitrate was added to the calcined product in a ratio of 5 mL of the aqueous solution per 1 g of the calcined product, and after heating at 100° C. with constant stirring for 2 hours, the mixture was filtered and washed with water. This operation was performed 4 times, and the product was then dried for 3 hours at 120° C., yielding an ammonium-type crystalline aluminogallosilicate.

The thus obtained ammonium-type crystalline aluminogallosilicate was mixed within an alumina binder (CATALOID AP (a product name), manufactured by Catalysts & Chemicals Industries Co., Ltd.) in a mass ratio of 70:30, water was added to the mixture, and the mixture was then subjected to kneading and extrusion molding. The resulting molded product was dried at 120° C. for 3 hours, was subsequently calcined for 3 hours at 780° C. in an air atmosphere, and was then crushed coarsely and classified using a 16 to 28 mesh size, thus yielding a catalyst-1.

Catalyst Preparation Example 2

Preparation of a Catalyst Containing a Ga-Supporting Crystalline Aluminosilicate A solution (A) composed of 1706.1 g of sodium silicate (J Sodium Silicate No. 3, $SiO_2$: 28 to 30% by mass, Na: 9 to 10% by mass, remainder: water, manufactured by Nippon Chemical Industrial Co., Ltd.) and 2227.5 g of water, and a solution (B-2) composed of 64.2 g of $Al_2(SO_4)_3.14\sim18H_2O$ (special reagent grade, manufactured by Wako Pure Chemical Industries, Ltd.), 369.2 g of tetrapropylammonium bromide, 152.1 g of $H_2SO_4$ (97% by mass), 326.6 g of NaCl and 2975.7 g of water were prepared independently.

Subsequently, with the solution (A) undergoing continuous stirring at room temperature, the solution (B-2) was added gradually to the solution (A). The resulting mixture was stirred vigorously for 15 minutes using a mixer, thereby breaking up the gel and forming a uniform fine milky mixture.

This mixture was placed in a stainless steel autoclave, and a crystallization operation was performed under conditions including a temperature of 165° C., a reaction time of 72 hours, a stirring rate of 100 rpm, and under self-generated pressure. Following completion of the crystallization operation, the product was filtered, the solid product was recovered, and an operation of washing the solid product and then performing filtration was performed 5 times, using a total of approximately 5 liters of deionized water in the 5 times of operations. The solid material obtained upon the final filtration was dried at 120° C., and was then calcined under a stream of air at 550° C. for 3 hours.

Analysis of the resulting calcined product by X-ray diffraction (apparatus model: Rigaku RINT-2500V) confirmed that the product had an MFI structure. Further, X-ray fluorescence analysis (apparatus model: Rigaku ZSX101e) revealed a $SiO_2/Al_2O_3$ ratio (molar ratio) of 64.8. Based on these results, the amount of aluminum element incorporated within the lattice framework was calculated as 1.32% by mass.

A 30% by mass aqueous solution of ammonium nitrate was added to the calcined product in a ratio of 5 mL of the aqueous solution per 1 g of the calcined product, and after heating at 100° C. with constant stirring for 2 hours, the mixture was filtered and washed with water. This operation was performed 4 times, and the product was then dried for 3 hours at 120° C., yielding an ammonium-type crystalline aluminosilicate. Subsequently, the product was calcined for 3 hours at 780° C., yielding a proton-type crystalline aluminosilicate.

Next, 120 g of the obtained proton-type crystalline aluminosilicate was impregnated with 120 g of an aqueous solution of gallium nitrate in order to support 0.4% by mass of gallium on the crystalline aluminosilicate (based on a value of 100% for the total mass of the crystalline aluminosilicate), and the resulting product was then dried at 120° C. Subsequently, the product was calcined for 3 hours at 780° C. under a stream of air, yielding a catalyst-2 containing a gallium-supporting crystalline aluminosilicate.

Catalyst Preparation Example 3

Preparation of a Catalyst Containing a Ga- and Phosphorus-Supporting Crystalline Aluminosilicate A solution (A) composed of 1706.1 g of sodium silicate (J Sodium Silicate No. 3, $SiO_2$: 28 to 30% by mass, Na: 9 to 10% by mass, remainder: water, manufactured by Nippon Chemical Industrial Co., Ltd.) and 2227.5 g of water, and a solution (B-2) composed of 64.2 g of $Al_2(SO_4)_3.14{\sim}18H_2O$ (special reagent grade, manufactured by Wako Pure Chemical Industries, Ltd.), 369.2 g of tetrapropylammonium bromide, 152.1 g of $H_2SO_4$ (97% by mass), 326.6 g of NaCl and 2975.7 g of water were prepared independently.

Subsequently, with the solution (A) undergoing continuous stirring at room temperature, the solution (B-2) was added gradually to the solution (A). The resulting mixture was stirred vigorously for 15 minutes using a mixer, thereby breaking up the gel and forming a uniform fine milky mixture.

This mixture was placed in a stainless steel autoclave, and a crystallization operation was performed under conditions including a temperature of 165° C., a reaction time of 72 hours, a stirring rate of 100 rpm, and under self-generated pressure. Following completion of the crystallization operation, the product was filtered, the solid product was recovered, and an operation of washing the solid product and then performing filtration was performed 5 times, using a total of approximately 5 liters of deionized water in the 5 times of operations. The solid material obtained upon the final filtration was dried at 120° C., and was then calcined under a stream of air at 550° C. for 3 hours.

Analysis of the resulting calcined product by X-ray diffraction (apparatus model: Rigaku RINT-2500V) confirmed that the product had an MFI structure. Further, X-ray fluorescence analysis (apparatus model: Rigaku ZSX101e) revealed a $SiO_2/Al_2O_3$ ratio (molar ratio) of 64.8. Based on these results, the amount of aluminum element incorporated within the lattice framework was calculated as 1.32% by mass.

A 30% by mass aqueous solution of ammonium nitrate was added to the calcined product in a ratio of 5 mL of the aqueous solution per 1 g of the calcined product, and after heating at 100° C. with constant stirring for 2 hours, the mixture was filtered and washed with water. This operation was performed 4 times, and the product was then dried for 3 hours at 120° C., yielding an ammonium-type crystalline aluminosilicate. Subsequently, the product was calcined for 3 hours at 780° C., yielding a proton-type crystalline aluminosilicate.

Next, 120 g of the obtained proton-type crystalline aluminosilicate was impregnated with 120 g of an aqueous solution of gallium nitrate in order to support 0.4% by mass of gallium on the crystalline aluminosilicate (based on a value of 100% for the total mass of the crystalline aluminosilicate), and the resulting product was then dried at 120° C. Subsequently, the product was calcined for 3 hours at 780° C. under a stream of air, yielding a gallium-supporting crystalline aluminosilicate.

Subsequently, 30 g of the obtained gallium-supporting crystalline aluminosilicate was impregnated with 30 g of an aqueous solution of diammonium hydrogen phosphate in order to support 0.7% by mass of phosphorus on the aluminosilicate (based on a value of 100% for the total mass of the crystalline aluminosilicate), and the resulting product was then dried at 120° C. Subsequently, the product was calcined for 3 hours at 780° C. under a stream of air, yielding a catalyst-3 containing the crystalline aluminosilicate, gallium and phosphorus.

Catalyst Preparation Example 4

Preparation of a Catalyst Containing a Zn-Supporting Crystalline Aluminosilicate A solution (A) composed of 1706.1 g of sodium silicate (J Sodium Silicate No. 3, $SiO_2$: 28 to 30% by mass, Na: 9 to 10% by mass, remainder: water, manufactured by Nippon Chemical Industrial Co., Ltd.) and 2227.5 g of water, and a solution (B-2) composed of 64.2 g of $Al_2(SO_4)_3.14{\sim}18H_2O$ (special reagent grade, manufactured by Wako Pure Chemical Industries, Ltd.), 369.2 g of tetrapropylammonium bromide, 152.1 g of $H_2SO_4$ (97% by mass), 326.6 g of NaCl and 2975.7 g of water were prepared independently.

Subsequently, with the solution (A) undergoing continuous stirring at room temperature, the solution (B-2) was added gradually to the solution (A). The resulting mixture was stirred vigorously for 15 minutes using a mixer, thereby breaking up the gel and forming a uniform fine milky mixture.

This mixture was placed in a stainless steel autoclave, and a crystallization operation was performed under conditions including a temperature of 165° C., a reaction time of 72 hours, a stirring rate of 100 rpm, and under self-generated pressure. Following completion of the crystallization operation, the product was filtered, the solid product was recovered, and an operation of washing the solid product and then performing filtration was performed 5 times, using a total of approximately 5 liters of deionized water in the 5 times of operations. The solid material obtained upon the final filtration was dried at 120° C., and was then calcined under a stream of air at 550° C. for 3 hours.

Analysis of the resulting calcined product by X-ray diffraction (apparatus model: Rigaku RINT-2500V) confirmed that the product had an MFI structure. Further, X-ray fluorescence analysis (apparatus model: Rigaku ZSX101e) revealed a $SiO_2/Al_2O_3$ ratio (molar ratio) of 64.8. Based on these results, the amount of aluminum element incorporated within the lattice framework was calculated as 1.32% by mass.

A 30% by mass aqueous solution of ammonium nitrate was added to the calcined product in a ratio of 5 mL of the aqueous solution per 1 g of the calcined product, and after heating at 100° C. with constant stirring for 2 hours, the mixture was filtered and washed with water. This operation was performed 4 times, and the product was then dried for 3 hours at 120° C., yielding an ammonium-type crystalline aluminosilicate. Subsequently, the product was calcined for 3 hours at 780° C., yielding a proton-type crystalline aluminosilicate.

Next, 120 g of the obtained proton-type crystalline aluminosilicate was impregnated with 120 g of an aqueous solution of zinc nitrate in order to support 0.4% by mass of zinc on the crystalline aluminosilicate (based on a value of 100% for the total mass of the crystalline aluminosilicate), and the resulting product was then dried at 120° C. Subsequently, the product was calcined for 3 hours at 780° C. under a stream of air, yielding a catalyst-4 containing a zinc-supporting crystalline aluminosilicate.

Catalyst Preparation Example 5

Preparation of a Powdered Catalyst for a Fluidized Bed

A mixed solution containing 106 g of sodium silicate (J Sodium Silicate No. 3, $SiO_2$: 28 to 30% by mass, Na: 9 to 10% by mass, remainder: water, manufactured by Nippon Chemical Industrial Co., Ltd.) and pure water was added dropwise to a dilute sulfuric acid solution to prepare a silica sol aqueous solution ($SiO_2$ concentration: 10.2%). Separately from the above, distilled water was added to 20.4 g of the gallium- and phosphorus-supporting crystalline aluminosilicate prepared in catalyst preparation example 3 to prepare a zeolite slurry. The zeolite slurry was mixed with 300 g of the silica sol aqueous solution, and the resulting slurry was spray dried at 250° C., yielding a spherically shaped catalyst. Subsequently, the catalyst was calcined for 3 hours at 600° C., yielding a powdered catalyst-5 having an average particle size of 85 μm and a bulk density of 0.75 g/cc.

The $SiO_2/Al_2O_3$ ratio (molar ratio) of the crystalline aluminosilicate within the powdered catalyst-5 excluding the binder was 64.8, the amount of gallium (based on a value of 100% for the total mass of the crystalline aluminosilicate) was 0.4% by mass, and the amount of phosphorus (based on a value of 100% for the total mass of the crystalline aluminosilicate) was 0.7% by mass (0.28% by mass based on the total mass of the catalyst).

Reference Example 1

Model Reaction for Hydrogen Transfer to a Polycyclic Aromatic Hydrocarbon Under Pressurized Conditions and in the Presence of a Multi-Branched Naphthene The hydrogen transfer reaction was investigated using a multi-branched naphthene as a hydrogen transfer agent.

1,2,4-trimethylcyclohexane (hereinafter referred to as TMCH) was used as the multi-branched naphthene.

1-methylnaphthalene was used as the polycyclic aromatic hydrocarbon.

TMCH by itself was used as a feedstock oil 1,1-methylnaphthalene by itself was used as a feedstock oil 2, and a mixture of the two compounds was used as a feedstock oil 3. The composition of each of these feedstock oils is shown in Table 1.

Using a flow-type reaction apparatus in which the reactor had been charged with 6 g of the catalyst-1, each of the feedstock oils 1, 2 and 3 was brought into contact with the catalyst and reacted under conditions including a reaction temperature of 540° C., a reaction pressure of 0.5 MPaG, and a LHSV of 0.7 $h^{-1}$. During the reaction, 47 $Ncm^3$ of nitrogen was introduced as a diluent so that the contact time between the feedstock oil and the catalyst was 4 seconds. Following reaction for 30 minutes, a compositional analysis of the products was performed using a gas chromatograph connected directly to the reaction apparatus. The results are shown in Table 1 and FIG. 1.

TABLE 1

| | Composition (% by mass) | | BTX yield (% by mass) | | |
|---|---|---|---|---|---|
| | TMCH | 1-methyl naphthalene | Reference example 1 (reaction pressure: 0.5 MPaG) | Reference example 2 (reaction pressure: 0 MPaG) | Reference example 3 (reaction pressure: 1.2 MPaG) |
| Feedstock oil 1 | 100 | 0 | 53 | 53 | 56 |
| Feedstock oil 2 | 0 | 100 | 3 | 1 | 4 |
| Feedstock oil 3 | 37 | 63 | 26 | 20 | 23 |

As is evident from FIG. 1, an additivity relationship is not established between the amount of TMCH in the feedstock oil and the BTX yield. In other words, the results prove that if a multi-branched naphthene and a polycyclic aromatic hydrocarbon are mixed together and then reacted under pressure, then a hydrogen transfer reaction occurs, enabling the polycyclic aromatic hydrocarbons to be converted to a BTX fraction.

Reference Example 2

Model Reaction for Hydrogen Transfer to a Polycyclic Aromatic Hydrocarbon Under Normal Pressure Conditions and in the Presence of a Multi-Branched Naphthene With the exception of altering the reaction pressure to 0.0 MPaG, reaction tests were performed under the same conditions as those described for reference example 1. The nitrogen introduction volume was the same as that for reference example 1, but because the reaction pressure was lower, the contact time for the feedstock oil with the catalyst shortened to 3 seconds. The results are shown in Table 1 and FIG. 2.

Figure 2:
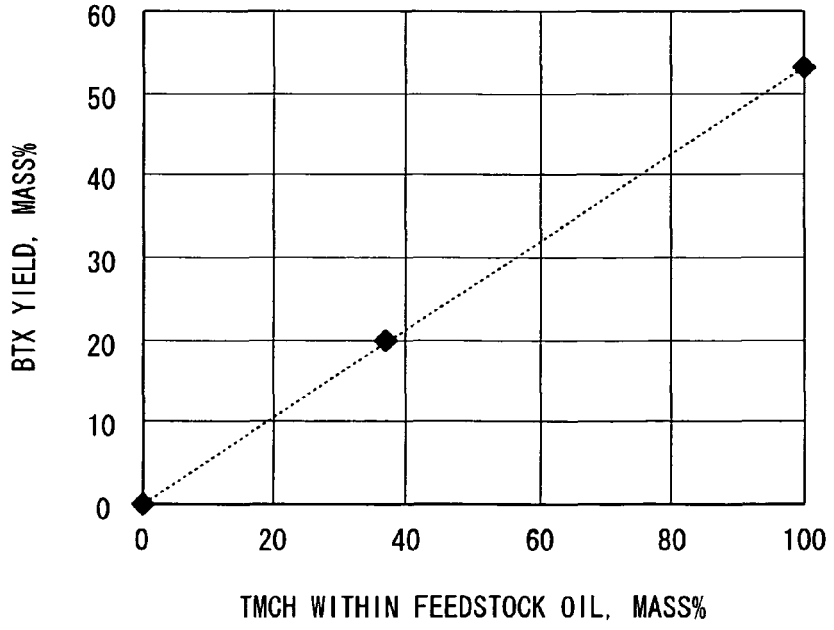
FIG. 2 is a graph illustrating the relationship between the proportion of 1,2,4-trimethylcyclohexane within a feedstock oil of a reference example 2, and the BTX yield.

As is evident from FIG. 2, an additivity relationship is substantially established between the amount of TMCH in the feedstock oil and the BTX yield. In other words, the results indicate that if a multi-branched naphthene and a polycyclic aromatic hydrocarbon are mixed together and then reacted without applying pressure, then a hydrogen transfer reaction is unlikely to occur.

Reference Example 3

Figure 3:
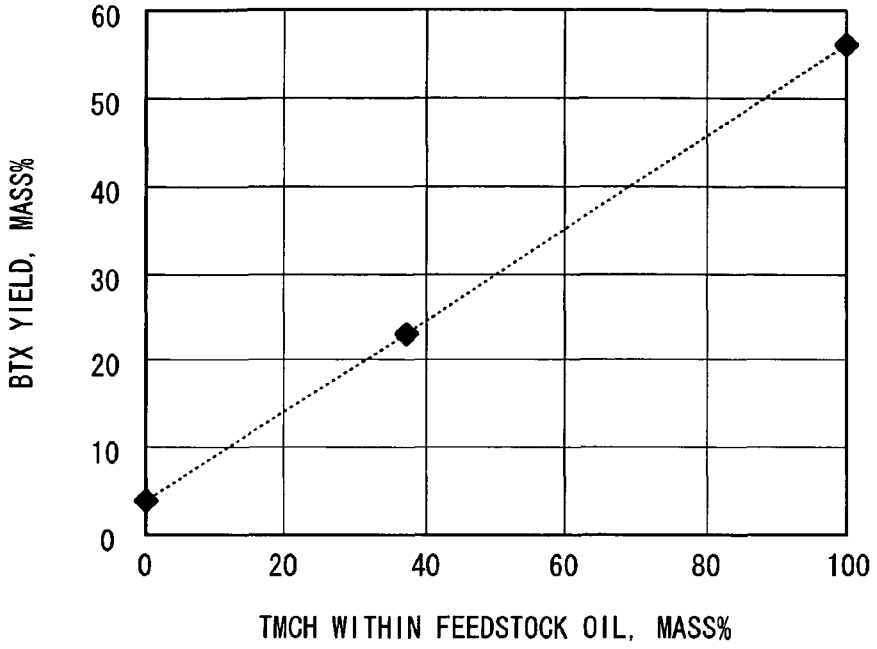
FIG. 3 is a graph illustrating the relationship between the proportion of 1,2,4-trimethylcyclohexane within a feedstock oil of a reference example 3, and the BTX yield.

Model Reaction for Hydrogen Transfer to a Polycyclic Aromatic Hydrocarbon Under Pressurized Conditions and in the Presence of a Multi-Branched Naphthene With the exception of altering the reaction pressure to 1.2 MPaG, reaction tests were performed under the same conditions as those described for reference example 1. The nitrogen introduction volume was the same as that for reference example 1, but because the reaction pressure had been increased, the contact time for the feedstock oil with the catalyst lengthened to 7 seconds. The results are shown in Table 1 and FIG. 3.

Reference Example 4

Model Reaction for Hydrogen Transfer to a Polycyclic Aromatic Hydrocarbon Under Pressurized Conditions and in the Presence of a Linear Paraffin The hydrogen transfer reaction was investigated using a linear paraffin as a hydrogen transfer agent.

Normal hexadecane was used as the linear paraffin.

1-methylnaphthalene was used as the polycyclic aromatic hydrocarbon.

Hexadecane by itself was used as a feedstock oil 4, 1-methylnaphthalene by itself was used as a feedstock oil 5, and a mixture of the two compounds was used as a feedstock oil 6. The composition of each of these feedstock oils is shown in Table 2.

With the exception of altering the feedstock oils to the feedstock oils 4, 5 and 6, reaction tests were performed under the same conditions as those described for reference example 1. The results are shown in Table 2 and FIG. 4.

TABLE 2

| | Composition (% by mass) | | BTX yield |
|---|---|---|---|
| | n-hexadecane | 1-methylnaphthalene | (% by mass) |
| Feedstock oil 4 | 100 | 0 | 56 |
| Feedstock oil 5 | 0 | 100 | 3 |
| Feedstock oil 6 | 76 | 24 | 43 |

Figure 4:
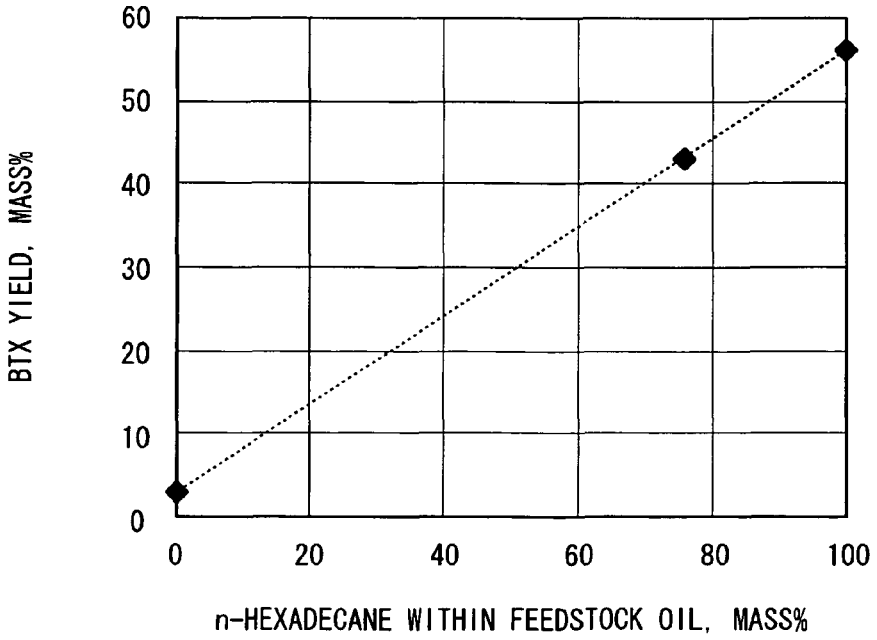
FIG. 4 is a graph illustrating the relationship between the proportion of normal hexadecane within a feedstock oil of a reference example 4, and the BTX yield.

As is evident from FIG. 4, an additivity relationship is established between the amount of normal hexadecane in the feedstock oil and the BTX yield. In other words, the results indicate that even if a linear paraffin and a polycyclic aromatic hydrocarbon are mixed together and then reacted under pressure, a hydrogen transfer reaction is unlikely to occur.

Comparative Example 1

Example Using LCO with Unadjusted Naphthene Content

A light cycle oil (LCO1) produced in a fluid catalytic cracking that had not been subjected to adjustment of the naphthene content was used as a feedstock oil. The composition of the feedstock oil was: paraffin content (excluding the naphthene content): 26% by mass, naphthene content: 14% by mass, monocyclic aromatic content: 23% by mass, bicyclic aromatic content: 32% by mass, and tricyclic aromatic content: 5% by mass.

Using a flow-type reaction apparatus in which the reactor had been charged with 6 g of the catalyst-1, the feedstock oil was brought into contact with the catalyst and reacted under conditions including a reaction temperature of 540° C., a reaction pressure of 0.3 MPaG, and a LHSV of 0.4 $h^{-1}$. During the reaction, 28 $Ncm^3$ of nitrogen was introduced as a diluent so that the contact time between the feedstock oil and the catalyst was 7 seconds. Following reaction for 30 minutes, a compositional analysis of the products was performed using a gas chromatograph connected directly to the reaction apparatus. The results are shown in Table 3 and FIG. 5.

Comparative Example 2

Example Using Only a Naphthene Modifier

A cracked gas oil fraction (hereinafter referred to as the "hydrotreated oil 1"), which was produced at the same time as a heavy oil hydrodesulfurization and functions as a naphthene modifier, was used as a feedstock oil. The composition of the feedstock oil was: paraffin content (excluding the naphthene content): 34% by mass, naphthene content: 30% by mass, monocyclic aromatic content: 32% by mass, bicyclic aromatic content: 3% by mass, and tricyclic aromatic content: 1% by mass.

With the exception of replacing the feedstock with the hydrotreated oil 1, a reaction test was performed under the same conditions as those described for comparative example 1. The results are shown in Table 3 and FIG. 5.

Example 1

Example Using a Mixture of an LCO and a Naphthene Modifier

Equal masses of the LCO used in comparative example 1 and the hydrotreated oil 1 used in comparative example 2 were mixed to prepare a feedstock oil having an adjusted naphthene content.

With the exception of replacing the feedstock with this feedstock oil having an adjusted naphthene content, a reaction test was performed under the same conditions as those described for comparative example 1. The results are shown in Table 3 and FIG. 5.

TABLE 3

| | Feedstock oil | Reaction pressure (MPaG) | Contact time (seconds) | Proportion of naphthene content (% by mass) | BTX yield (% by mass) |
|---|---|---|---|---|---|
| Comparative example 1 | LCO only | 0.3 | 7 | 14 | 34 |
| Comparative example 2 | Hydrotreated oil | 0.3 | 7 | 40 | 44 |
| Example 1 | LCO + Hydrotreated oil | 0.3 | 7 | 27 | 43 |

Figure 5:
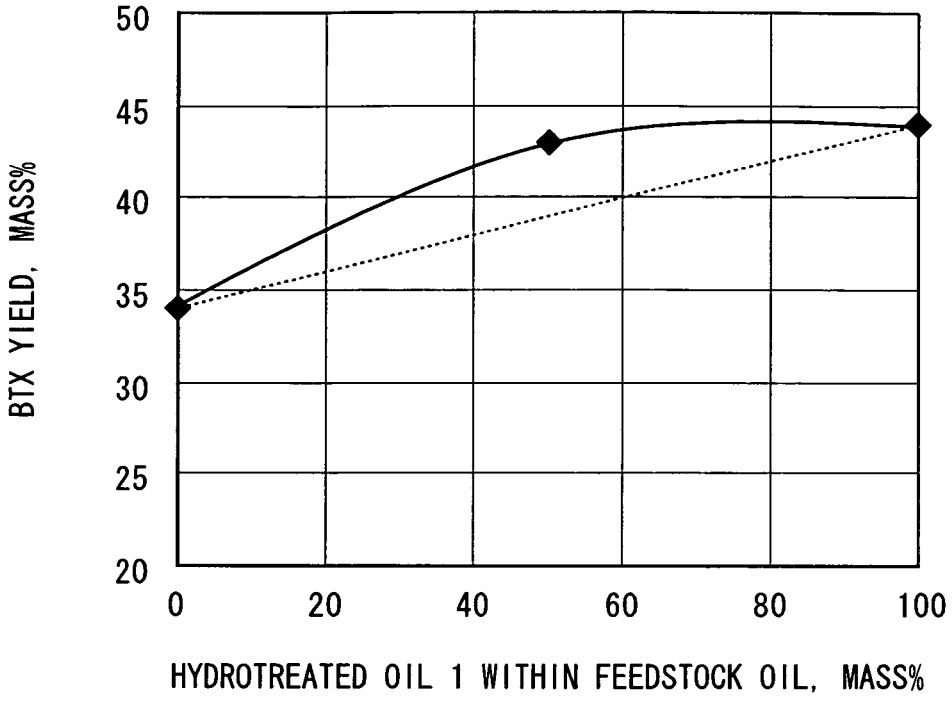
FIG. 5 is a graph illustrating the relationship between the proportion of a naphthene modifier (a cracked gas oil fraction produced at the same time as heavy oil hydrodesulfurization) within feedstock oils of comparative examples 1 and 2 and example 1, and the BTX yield.

As is evident from FIG. 5, an additivity relationship is not established between the proportion of the hydrotreated oil 1 in the feedstock oil and the BTX yield. In other words, the results provide proof that if a fraction having a large naphthene content and an LCO are mixed together and then reacted under pressure, then a hydrogen transfer reaction occurs.

Comparative Example 3

Example Using an LCO with an Unadjusted Naphthene Content

An LCO (LCO2) having a naphthene content of less than 10% by mass was used as a feedstock oil. The composition of the feedstock oil was: paraffin content (excluding the naphthene content): 17% by mass, naphthene content: 5% by mass, monocyclic aromatic content: 20% by mass, bicyclic aromatic content: 55% by mass, and tricyclic aromatic content: 3% by mass.

Using a flow-type reaction apparatus in which the reactor had been charged with 6 g of the catalyst-1, the feedstock oil was brought into contact with the catalyst and reacted under conditions including a reaction temperature of 540° C., a reaction pressure of 0.3 MPaG, and a LHSV of 0.4 $h^{-1}$. During the reaction, 28 $Ncm^3$ of nitrogen was introduced as a diluent so that the contact time of the feedstock oil with the catalyst was 7 seconds. Following reaction for 30 minutes, a compositional analysis of the products was performed using a gas chromatograph connected directly to the reaction apparatus. The results are shown in Table 4.

Example 2

Example Using Partially Hydrogenated LCO

An oil prepared by partially hydrogenating the LCO (LCO2) of comparative example 3 in order to increase the proportion of the naphthene content within the oil (namely, a partially hydrogenated LCO) was used as a feedstock oil. The composition of the feedstock oil was: paraffin content (excluding the naphthene content): 38% by mass, naphthene content: 23% by mass, monocyclic aromatic content: 25% by mass, bicyclic aromatic content: 12% by mass, and tricyclic aromatic content: 2% by mass.

Using a flow-type reaction apparatus in which the reactor had been charged with 6 g of the catalyst-1, the feedstock oil was brought into contact with the catalyst and reacted under conditions including a reaction temperature of 540° C., a reaction pressure of 0.3 MPaG, and LHSV=0.4 $h^{-1}$ (or LHSV=0.22 $h^{-1}$). During the reaction, 28 $Ncm^3$ (or 17 $Ncm^3$) of nitrogen was introduced as a diluent so that the contact time with the catalyst was 7 seconds (or 12 seconds). Following reaction for 30 minutes, a compositional analysis of the products was performed using a gas chromatograph connected directly to the reaction apparatus. The results are shown in Table 4.

Example 3

Example Using a Mixture of an LCO and a Partially Hydrogenated LCO

Equal masses of the LCO (LCO2) used in comparative example 3 and the oil used in example 2 that was prepared by partially hydrogenating the LCO2 (partially hydrogenated LCO) were mixed to prepare a feedstock oil having an adjusted naphthene content.

With the exception of replacing the feedstock with this feedstock oil having an adjusted naphthene content, a reaction test was performed under the same conditions as those described for example 2. The results are shown in Table 4.

TABLE 4

| | Feedstock oil | Reaction pressure (MPaG) | Contact time (seconds) | Proportion of naphthene content (% by mass) | BTX yield (% by mass) |
|---|---|---|---|---|---|
| Comparative example 3 | LCO only | 0.3 | 7 | 5 | 28 |
| Example 2 | Partially hydrogenated LCO only | 0.3 | 7<br>12 | 23 | 40<br>46 |
| Example 3 | LCO + partially hydrogenated LCO | 0.3 | 7<br>12 | 14 | 38<br>43 |

Comparative Example 4

Example Using an LCO with an Unadjusted Naphthene Content

The LCO1 having an unadjusted naphthene content was used as a feedstock oil. The composition of the feedstock oil was: paraffin content (excluding the naphthene content): 26% by mass, naphthene content: 14% by mass, monocyclic aromatic content: 23% by mass, bicyclic aromatic content: 32% by mass, and tricyclic aromatic content: 5% by mass.

Using a flow-type reaction apparatus in which the reactor had been charged with 6 g of the catalyst-2, the feedstock oil was brought into contact with the catalyst and reacted under conditions including a reaction temperature of 540° C., a reaction pressure of 0.3 MPaG, and a LHSV of 0.4 $h^{-1}$. During the reaction, 28 $Ncm^3$ of nitrogen was introduced as a diluent so that the contact time between the feedstock oil and the catalyst was 7 seconds. Following reaction for 30 minutes, a compositional analysis of the products was performed using a gas chromatograph connected directly to the reaction apparatus. The results are shown in Table 5.

Comparative Example 5

Example Using Only a Naphthene Modifier

A cracked gas oil fraction (the hydrotreated oil 1), which was produced at the same time as a heavy oil hydrodesulfurization and functions as a naphthene modifier, was used as a feedstock oil. The composition of the feedstock oil was: paraffin content (excluding the naphthene content): 34% by mass, naphthene content: 30% by mass, monocyclic aromatic content: 32% by mass, bicyclic aromatic content: 3% by mass, and tricyclic aromatic content: 1% by mass.

With the exception of replacing the feedstock with the hydrotreated oil 1, a reaction test was performed under the same conditions as those described for comparative example 4. The results are shown in Table 5.

Example 4

Example Using a Mixture of an LCO and a Naphthene Modifier

Equal masses of the LCO1 used in comparative example 4 and the hydrotreated oil 1 used in comparative example 5 were mixed to prepare a feedstock oil having an adjusted naphthene content.

With the exception of replacing the feedstock with this feedstock oil having an adjusted naphthene content, a reaction test was performed under the same conditions as those described for comparative example 4. The results are shown in Table 5.

TABLE 5

| | Feedstock oil | Reaction pressure (MPaG) | Contact time (seconds) | Proportion of naphthene content (% by mass) | BTX yield (% by mass) |
|---|---|---|---|---|---|
| Comparative example 4 | LCO1 only | 0.3 | 7 | 14 | 40 |
| Comparative example 5 | Hydrotreated oil 1 | 0.3 | 7 | 40 | 52 |
| Example 4 | LCO1 + Hydrotreated oil 1 | 0.3 | 7 | 27 | 50 |

Comparative Example 6

Example Using an LCO with an Unadjusted Naphthene Content

The LCO1 having an unadjusted naphthene content was used as a feedstock oil. The composition of the feedstock oil was: paraffin content (excluding the naphthene content): 26% by mass, naphthene content: 14% by mass, monocyclic aromatic content: 23% by mass, bicyclic aromatic content: 32% by mass, and tricyclic aromatic content: 5% by mass.

Using a flow-type reaction apparatus in which the reactor had been charged with 6 g of the catalyst-3, the feedstock oil was brought into contact with the catalyst and reacted under conditions including a reaction temperature of 540° C., a reaction pressure of 0.3 MPaG, and a LHSV of 0.4 $h^{-1}$. During the reaction, 28 $Ncm^3$ of nitrogen was introduced as a diluent so that the contact time between the feedstock oil and the catalyst was 7 seconds. Following reaction for 30 minutes, a compositional analysis of the products was performed using a gas chromatograph connected directly to the reaction apparatus. The results are shown in Table 6.

Comparative Example 7

Example Using Only a Naphthene Modifier

A cracked gas oil fraction (the hydrotreated oil 1), which was produced at the same time as a heavy oil hydrodesulfurization and functions as a naphthene modifier, was used as a feedstock oil. The composition of the feedstock oil was: paraffin content (excluding the naphthene content): 34% by mass, naphthene content: 30% by mass, monocyclic aromatic content: 32% by mass, bicyclic aromatic content: 3% by mass, and tricyclic aromatic content: 1% by mass.

With the exception of replacing the feedstock with the hydrotreated oil 1, a reaction test was performed under the same conditions as those described for comparative example 6. The results are shown in Table 6.

Example 5

Example Using a Mixture of an LCO and a Naphthene Modifier

Equal masses of the LCO1 used in comparative example 6 and the hydrotreated oil 1 used in comparative example 7 were mixed to prepare a feedstock oil having an adjusted naphthene content.

With the exception of replacing the feedstock with this feedstock oil having an adjusted naphthene content, a reaction test was performed under the same conditions as those described for comparative example 6. The results are shown in Table 6.

TABLE 6

| | Feedstock oil | Reaction pressure (MPaG) | Contact time (seconds) | Proportion of naphthene content (% by mass) | BTX yield (% by mass) |
|---|---|---|---|---|---|
| Comparative example 6 | LCO1 only | 0.3 | 7 | 14 | 38 |
| Comparative example 7 | Hydrotreated oil 1 | 0.3 | 7 | 40 | 51 |
| Example 5 | LCO1 + Hydrotreated oil 1 | 0.3 | 7 | 27 | 49 |

Comparative Example 8

Example Using an LCO with an Unadjusted Naphthene Content

The LCO1 having an unadjusted naphthene content was used as a feedstock oil. The composition of the feedstock oil was: paraffin content (excluding the naphthene content): 26% by mass, naphthene content: 14% by mass, monocyclic aromatic content: 23% by mass, bicyclic aromatic content: 32% by mass, and tricyclic aromatic content: 5% by mass.

Using a flow-type reaction apparatus in which the reactor had been charged with 6 g of the catalyst-4, the feedstock oil was brought into contact with the catalyst and reacted under conditions including a reaction temperature of 540° C., a reaction pressure of 0.3 MPaG, and a LHSV of 0.4 $h^{-1}$. During the reaction, 28 $Ncm^3$ of nitrogen was introduced as a diluent so that the contact time between the feedstock oil and the catalyst was 7 seconds. Following reaction for 30 minutes, a compositional analysis of the products was performed using a gas chromatograph connected directly to the reaction apparatus. The results are shown in Table 7.

Comparative Example 9

Example Using Only a Naphthene Modifier

A cracked gas oil fraction (the hydrotreated oil 1), which was produced at the same time as a heavy oil hydrodesulfurization and functions as a naphthene modifier, was used as a feedstock oil. The composition of the feedstock oil was: paraffin content (excluding the naphthene content): 34% by mass, naphthene content: 30% by mass, monocyclic aromatic content: 32% by mass, bicyclic aromatic content: 3% by mass, and tricyclic aromatic content: 1% by mass.

With the exception of replacing the feedstock with the hydrotreated oil 1, a reaction test was performed under the same conditions as those described for comparative example 8. The results are shown in Table 7.

Example 6

Example Using a Mixture of an LCO and a Naphthene Modifier

Equal masses of the LCO1 used in comparative example 8 and the hydrotreated oil 1 used in comparative example 9 were mixed to prepare a feedstock oil having an adjusted naphthene content.

With the exception of replacing the feedstock with this feedstock oil having an adjusted naphthene content, a reaction test was performed under the same conditions as those described for comparative example 8. The results are shown in Table 7.

TABLE 7

| | Feedstock oil | Reaction pressure (MPaG) | Contact time (seconds) | Proportion of naphthene content (% by mass) | BTX yield (% by mass) |
|---|---|---|---|---|---|
| Comparative example 8 | LCO1 only | 0.3 | 7 | 14 | 41 |
| Comparative example 9 | Hydrotreated oil 1 | 0.3 | 7 | 40 | 52 |
| Example 6 | LCO1 + Hydrotreated oil 1 | 0.3 | 7 | 27 | 51 |

Comparative Example 10

Example Using an LCO with an Unadjusted Naphthene Content

The LCO1 having an unadjusted naphthene content was used as a feedstock oil. The composition of the feedstock oil was: paraffin content (excluding the naphthene content): 26% by mass, naphthene content: 14% by mass, monocyclic aromatic content: 23% by mass, bicyclic aromatic content: 32% by mass, and tricyclic aromatic content: 5% by mass.

Using a flow-type reaction apparatus in which the reactor had been charged with 6 g of the catalyst-5, the feedstock oil was brought into contact with the catalyst and reacted under conditions including a reaction temperature of 540° C., a reaction pressure of 0.3 MPaG, and a LHSV of 0.4 $h^{-1}$. During the reaction, 28 $Ncm^3$ of nitrogen was introduced as a diluent so that the contact time between the feedstock oil and the catalyst was 7 seconds. Following reaction for 30 minutes, a compositional analysis of the products was performed using a gas chromatograph connected directly to the reaction apparatus. The results are shown in Table 8.

Comparative Example 11

Example Using Only a Naphthene Modifier

A cracked gas oil fraction (the hydrotreated oil 1), which was produced at the same time as a heavy oil hydrodesulfurization and functions as a naphthene modifier, was used as a feedstock oil. The composition of the feedstock oil was: paraffin content (excluding the naphthene content): 34% by mass, naphthene content: 30% by mass, monocyclic aromatic content: 32% by mass, bicyclic aromatic content: 3% by mass, and tricyclic aromatic content: 1% by mass.

With the exception of replacing the feedstock with the hydrotreated oil 1, a reaction test was performed under the same conditions as those described for comparative example 10. The results are shown in Table 8.

Example 7

Example Using a Mixture of an LCO and a Naphthene Modifier

Equal masses of the LCO1 used in comparative example 10 and the hydrotreated oil 1 used in comparative example 11 were mixed to prepare a feedstock oil having an adjusted naphthene content.

With the exception of replacing the feedstock with this feedstock oil having an adjusted naphthene content, a reaction test was performed under the same conditions as those described for comparative example 10. The results are shown in Table 8.

TABLE 8

| | Feedstock oil | Reaction pressure (MPaG) | Contact time (seconds) | Proportion of naphthene content (% by mass) | BTX yield (% by mass) |
|---|---|---|---|---|---|
| Comparative example 10 | LCO1 only | 0.3 | 7 | 14 | 36 |
| Comparative example 11 | Hydrotreated oil 1 | 0.3 | 7 | 40 | 47 |
| Example 7 | LCO1 + Hydrotreated oil 1 | 0.3 | 7 | 27 | 45 |

INDUSTRIAL APPLICABILITY

The method for producing aromatic hydrocarbons according to the present invention is useful for producing monocyclic aromatic hydrocarbons which can be used as high-octane gasoline base stocks or petrochemical feedstocks and offer significant added value.

The invention claimed is:

1. A method for producing monocyclic aromatic hydrocarbons of 6 to 8 carbon number, comprising contacting a feedstock derived from a fraction comprising a light cycle oil produced in a fluid catalytic cracking unit with a catalyst comprising a crystalline aluminosilicate in the absence of molecular hydrogen, wherein the feedstock has a 10 volume % distillation temperature of at least 140° C., and a 90 volume % distillation temperature of not more than 360° C., a proportion of a saturated, multi-branched naphthene content in the feedstock is adjusted by mixing the fraction comprising the light cycle oil with a hydrotreated oil or by partially hydrogenating the fraction comprising the light cycle oil so that a proportion of the saturated, multi-branched naphthene content in the feedstock is greater than a proportion of a saturated, multi-branched naphthene content in the fraction comprising the light cycle oil, and the contacting the feedstock with the catalyst is performed under a pressure within a range from 0.1 MPaG to 1.0 MPaG, and a contact time between the feedstock and the catalyst during the contacting the feedstock with the catalyst is within a range from 5 seconds to 300 seconds, and wherein the proportion of the saturated, multi-branched naphthene content in the feedstock is at least 27% by mass.

2. The method for producing monocyclic aromatic hydrocarbons of 6 to 8 carbon number according to claim 1, wherein the proportion of the saturated, multi-branched naphthene content in the feedstock is adjusted by mixing the fraction comprising the light cycle oil with a partially hydrogenated product of the fraction comprising the light cycle oil.

3. The method for producing monocyclic aromatic hydrocarbons of 6 to 8 carbon number according to claim 1, wherein the saturated, multi-branched naphthene comprises mainly naphthene components of 8 or more carbon number.

4. The method for producing monocyclic aromatic hydrocarbons of 6 to 8 carbon number according to claim 1, wherein the catalyst further comprises at least one metal selected from the group consisting of gallium and zinc.

5. The method for producing monocyclic aromatic hydrocarbons of 6 to 8 carbon number according to claim 1, wherein a mass ratio of the naphthene content to a polycyclic aromatic hydrocarbon content in the feedstock is within a range from 0.1 to 5.0.

* * * * *